US008181361B2

(12) United States Patent
Kimura

(10) Patent No.: US 8,181,361 B2
(45) Date of Patent: May 22, 2012

(54) SOLE STRUCTURE FOR A SHOE

(75) Inventor: Takaya Kimura, Kobe (JP)

(73) Assignee: Mizuno Corporation, Osaka-shi (JP)

( * ) Notice: Subject to any disclaimer, the term of this patent is extended or adjusted under 35 U.S.C. 154(b) by 570 days.

(21) Appl. No.: 12/380,259

(22) Filed: Feb. 24, 2009

(65) Prior Publication Data

US 2009/0241370 A1 Oct. 1, 2009

(30) Foreign Application Priority Data

Mar. 28, 2008 (JP) ..... 2008-86372

(51) Int. Cl.
*A43B 13/18* (2006.01)

(52) U.S. Cl. ..... 36/28; 36/25 R; 36/35 R

(58) Field of Classification Search ..... 36/25 R, 36/27, 28, 29, 35 R, 38
See application file for complete search history.

(56) References Cited

U.S. PATENT DOCUMENTS

| | | | | |
|---|---|---|---|---|
| 5,224,277 | A * | 7/1993 | Sang Do | 36/27 |
| 5,279,051 | A * | 1/1994 | Whatley | 36/25 R |
| 5,686,167 | A * | 11/1997 | Rudy | 428/178 |
| 5,822,886 | A * | 10/1998 | Luthi et al. | 36/28 |
| 6,018,889 | A * | 2/2000 | Friton | 36/28 |
| 6,266,897 | B1 * | 7/2001 | Seydel et al. | 36/29 |
| 6,625,905 | B2 * | 9/2003 | Kita | 36/30 R |
| 7,314,125 | B2 * | 1/2008 | Smaldone et al. | 188/372 |
| 7,331,124 | B2 * | 2/2008 | Meschan | 36/35 R |
| 7,484,317 | B2 | 2/2009 | Kita et al. | |
| 7,779,558 | B2 * | 8/2010 | Nishiwaki et al. | 36/27 |
| 2006/0265902 | A1 | 11/2006 | Kita et al. | |
| 2007/0033830 | A1 * | 2/2007 | Chang | 36/28 |
| 2008/0034615 | A1 * | 2/2008 | Nishiwaki et al. | 36/27 |
| 2008/0289224 | A1 * | 11/2008 | Sink | 36/103 |

FOREIGN PATENT DOCUMENTS

| | | |
|---|---|---|
| JP | 11-235202 | 8/1999 |
| JP | 2003-339405 | 12/2003 |
| WO | WO 2006/129837 | 12/2006 |

* cited by examiner

*Primary Examiner* — Marie Patterson
(74) *Attorney, Agent, or Firm* — W. F. Fasse

(57) ABSTRACT

A sole structure 1 for a shoe comprises an upper plate 2 having a heel region and disposed on the upper side of the structure 1, a first C-shaped portion 3 and a second C-shaped portion 4 each having a longitudinally flat, generally C-shape with an upwardly opening portion 3A, 4A, disposed alongside in the longitudinal direction under the upper plate 2, and each opening end of the upwardly opening portions 3A, 4A directly fixed to the upper plate 2, and a connecting portion 5 interposed between and connecting the first and second C-shaped portions 3. The C-shaped portions 3, 4 are formed of downwardly convexly curved surfaces 30, 40 and diagonally upwardly convexly curved surfaces 31, 41, respectively, which extend diagonally upwardly from the downwardly convexly curved surfaces 30, 40 toward the upper plate 2.

28 Claims, 8 Drawing Sheets

SOLE STRUCTURE FOR A SHOE

BACKGROUND OF THE INVENTION

The present invention relates generally to a sole structure for a shoe, and more particularly, to an improved sole structure for facilitating a compressive deformation to enhance cushioning properties and for reducing a thrust from the ground.

We proposed a sole structure such as shown in Japanese patent application laying-open publication No. 11-235202 (JP 11-235202). The sole structure is comprised of a plurality of band-shaped wavy corrugated sheets arranged side by side and connections that connect the adjacent wavy corrugated sheets with each other.

Also, Japanese patent application laying-open publication No. 2003-339405 (JP 2003-339405) shows a sole structure composed of an upper plate and a lower plate that are disposed oppositely to each other via a void in the upper and lower direction, and a wavy corrugated plate that is interposed between the upper plate and the lower plate and that has an upwardly convex surface fixedly attached to the upper plate and a downwardly convex surface fixedly attached to the lower plate.

Further, WO 2006/129837 shows a sole structure composed of an upper plate, a wavy corrugated lower plate disposed under the upper plate and having two bulges that form a void with the upper plate, and an elastic block member that couples an upwardly convex portion formed between the two bulges to the upper plate.

In the above-mentioned sole structure shown in JP 11-235202, at the time of a shoe strike onto the ground, each of wavy corrugated portions of the band-shaped wavy corrugated sheets compressively deforms into a more flattened shape and at this time each of the connections is twisted by each of the wavy corrugated portions to function as a torsion bar. As a result, in conjunction with the deformation of each of the wavy corrugated portions of the wavy corrugated sheets, an impact load is absorbed.

However, in this case, since the adjacent band-shaped wavy corrugated sheets are coupled to each other by the connections, the amount of compressive deformation of the wavy corrugated portions of the band-shaped wavy corrugated sheets is restricted.

Also, in the above-mentioned sole structure shown in JP 2003-339405, at the time of a shoe strike onto the ground, each of wavy corrugated portions of the wavy corrugated plate compressively deforms into a more flattened shape and the void between the upper plate and the lower plate thus acts as a cushioning hole to absorb an impact load.

However, in this case, since the upwardly convex surface of the wavy corrugated plate is fixedly attached to the upper plate and the downwardly convex surface of the wavy corrugated plate is fixedly attached to the lower plate and the upwardly and downwardly convex surfaces of the wavy corrugated plate are thus restrained by the upper and lower plates, the amount of compressive deformation of the wavy corrugated portions of the wavy corrugated plate is restricted.

Further, in the above-mentioned sole structure shown in WO 2006/129837, at the time of a shoe strike onto the ground, each of the bulges of the lower plate is compressively deforms into a more flattened shape and the void between the upper and lower plates thus functions as a cushioning hole to absorb an impact load.

In this case, as compared with the sole structures of JP 11-235202 and JP 2003-339405, since the upwardly convex portion between the bulges of the lower plate is connected to the upper plate through the elastic block member a compressive deformation of each of the bulges is relatively facilitated and the cushioning properties are improved.

However, in this case, the lower plate is connected to the upper plate through three connecting portions formed of the elastic block member and front and rear connections. Thereby, a thrust acting from the ground at the time of the shoe strike onto the ground is propagated from the lower plate to the upper plate through these three connecting portions.

On the other hand, there exists a demand in the shoe industry that they want to relieve as much thrust as possible acting from the ground to a shoe wearer's foot at the time of a shoe strike onto the ground.

The present invention is directed to providing a sole structure for a shoe that can facilitate a compressive deformation to improve cushioning properties and that can relieve a thrust from the ground.

Other objects and advantages of the present invention will be obvious and appear hereinafter.

SUMMARY OF THE INVENTION

A sole structure for a shoe according to the present invention comprises an upper plate having at least a heel region and disposed on an upper side of the sole structure, a first C-shaped portion and a second C-shaped portion each having a longitudinally flat, generally C-shape with an upwardly opening portion, disposed alongside in the longitudinal direction under the upper plate, and each opening end of the upwardly opening portions being directly fixed to the upper plate, and a connecting portion interposed between the first and second C-shaped portions and connecting the first and second C-shaped portions.

According to the present invention, at the time of a shoe strike onto the ground, each of the first and second C-shaped portions compressively deforms into a more flattened shape to absorb a shock load. Also, at this juncture, since the first and second C-shaped portions are coupled to each other through the connecting portion, each of the C-shaped portions is prevented from being excessively shaken in the longitudinally direction when each of the C-shaped portions deforms compressively. Moreover, in this case, though each of the C-shaped portions is fixed to the upper plate, the entire C-shape deforms compressively in the upper and lower directions at the time of the compressive deformation of each of the C-shaped portions. Thereby, the compressive deformation can be facilitated and cushioning properties can thus be improved.

In such a manner, since each of the C-shaped portions has a structure that can facilitate a compressive deformation, in the case as well where each of the C-shaped portions is formed of material of a relatively high rigidity (e.g. material of a high Young's modulus), the cushioning properties can be secured, thereby causing the cushioning properties and durability to be compatible with each other.

Also, in this invention, each of the first and second C-shaped portions is fixed to the upper plate through the opening end and therefore the first and second C-shaped portions are coupled to the upper plate through four coupling points. In this case, at the time of a shoe strike onto the ground, a thrust from the ground is transmitted to the upper plate through these four coupling points, and as a result a thrust to a sole of a shoe wearer can be relieved.

Each of the first and second C-shaped portions may comprise a downwardly convexly curved surface disposed under and opposite the upwardly opening portion, and a diagonally upwardly convexly curved surface extending diagonally upwardly from the downwardly convexly curved surface toward the upper plate.

In this case, at the time of a shoe strike onto the ground, since the downwardly convexly curved surface compressively deforms into a more flattened shape and the diagonally upwardly convexly curved surface deforms into a more flattened shape or more flatter shape or a diagonally downwardly convexly curved shape, thus further facilitating a compressive deformation of each of the first and second C-shaped portions to further enhance the cushioning properties.

The downwardly convexly curved surface and the diagonally upwardly convexly curved surface may be coupled to each other through a longitudinally convexed curved surface.

In this case, at the time of a shoe strike onto the ground, the longitudinally convexed curved surface compressively deforms into a more curved surface, thus still further facilitating a compressive deformation of each of the first and second C-shaped portions to much further enhance the cushioning properties.

The downwardly convexly curved surface of one C-shaped portion located in front of the other C-shaped portion of the first and second C-shaped portions may extend beyond the one C-shaped portion in a further forward direction, and a front end of the downwardly convexly curved surface located forward may be fixedly attached to a lower surface of the upper plate.

In this case, at the time of a compressive deformation of the C-shaped portion located forward, the C-shaped portion is prevented from being excessively shaken in the forward direction by an extension of the downwardly convexly curved surface of the C-shaped portion located forward.

The connecting portion may connect an end of the downwardly convexly curved surface of the first C-shaped portion with an end of the downwardly convexly curved surface of the second C-shaped portion.

In this case, a compressive deformation of each of the downwardly convexly curved surfaces of the first and second C-shaped portions is not hindered by the connecting portion to allow for a smooth compressive deformation of each of the downwardly convexly curved surfaces.

The opening ends of the upwardly opening portions of the first and second C-shaped portions fixed to the upper plate may be spaced equally along the upper plate.

In this case, since a distance between the four connecting portions of the first and second C-shaped portions is equal along the upper plate, at the time of a shoe strike onto the ground, a thrust from the ground is equally distributed and transmitted to the upper plate via these four connecting portions. Thereby, an undesirable thrust to the foot of the shoe wearer can be further reduced.

The heel region of the upper plate may have an upraised portion projecting upwardly from a side edge portion of the heel region, and a side edge portion of each of the first and second C-shaped portions may have an upwardly extending portion along the upraised portion.

In this case, since each of the C-shaped portions is attached to the upraised portion of the heel region of the upper plate via the upwardly extending portion, this upwardly extending portion can exhibit a stabilizer effect in the lateral direction.

The connecting portion may be located below a longitudinal line that connects the longitudinally most protruded point of the first C-shaped portion and the longitudinally most protruded point of the second C-shaped portion.

In this case, at the time of a compressive deformation of each of the C-shaped portions, a compressive deformation of an upper portion above the longitudinal line is promoted, whereas a compressive deformation of a lower portion below the longitudinal line is restrained. Thereby, the amount of a compressive deformation of each of the C-shaped portions can be controlled.

The connecting portion may be located above the longitudinal line that connects the longitudinally most protruded point of the first C-shaped portion and the longitudinally most protruded point of the second C-shaped portion.

In this case, at the time of a compressive deformation of each of the C-shaped portions, a compressive deformation of a lower portion below the longitudinal line is promoted, whereas a compressive deformation of an upper portion above the longitudinal line is restrained. Thereby, the amount of a compressive deformation of each of the C-shaped portions can be controlled.

The connecting portion may have an upwardly convexed curved shape.

In this case, since the first and second C-shaped portions and the connecting portion are formed in a longitudinally waved shape as a whole, the entire sole structure can deform compressively in a smoother manner and the cushioning properties can thus be improved. In such a case, when the connecting portion is located above the longitudinal line that connects the longitudinally most protruded points of the first and second C-shaped portions, at the time of a compressive deformation of each of the C-shaped portions, a compressive deformation of an lower portion below the longitudinal line can be promoted and the amount of compressive deformation of the entire sole structure can be increased.

The connecting portion may have an upwardly convexed crooked shape.

In this case, at the time of a compressive deformation of each of the C-shaped portions, since the connecting portion deforms crookedly so as to increase the degree of crookedness, the amount of the compressive deformation of the entire sole structure can be increased and the cushioning properties can be improved.

The upper plate, each of the first and second C-shaped portions, and the connecting portion may be resin-formed integrally with each other.

In such a case, the entire sole structure can be manufactured with ease and the manufacturing cost can be reduced. Also, separation of each of the C-shaped portions from the upper plate or the connecting portion due to a repetitive deformation of each of the C-shaped portions can be prevented.

A void filled with cushioning materials may be formed above the connecting portion.

In such a case, elasticity of the cushioning materials controls the amount of the C-shaped portions and the connecting portion to adjust the cushioning properties.

A cleat may be provided at a lower portion of the downwardly convexed curved surface disposed opposite the opening portion of the C-shaped portion.

In such a case, at the time of a cleat contact with the ground, the first and second C-shaped portions compressively deforms into a more flattened shape through the cleat, thus relieving a thrust from the ground.

A cleat may be provided at a lower portion of the connecting portion.

In such a case, at the time of a shoe strike onto the ground, the cleat contacts the ground first and thereafter the first and second C-shaped portions contact the ground to compressively deform into a more flattened shape. As a result, the amount of protrusion of the cleat from the lower surface of each of the C-shaped portions increases to raise a grip of the cleat. On the other hand, when each of the C-shaped portions leaves the ground, the lower surface of each of the C-shaped portions returns to its original position. As a result, the amount of protrusion of the cleat from the lower surface of each of the C-shaped portions decreases to allow for an easy pull-out of the cleat from the ground.

The cleat may be provided via a base portion. In such a case, the rigidity of the connecting portion having the cleat provided increases to restrain deformation of the connecting portion in the upper and lower direction. Thereby, traction of the cleat relative to the ground can be effectively exhibited. Also, in this case, the amount of a stab of the cleat into the ground can be controlled by the upward or downward position of the base portion of the cleat.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
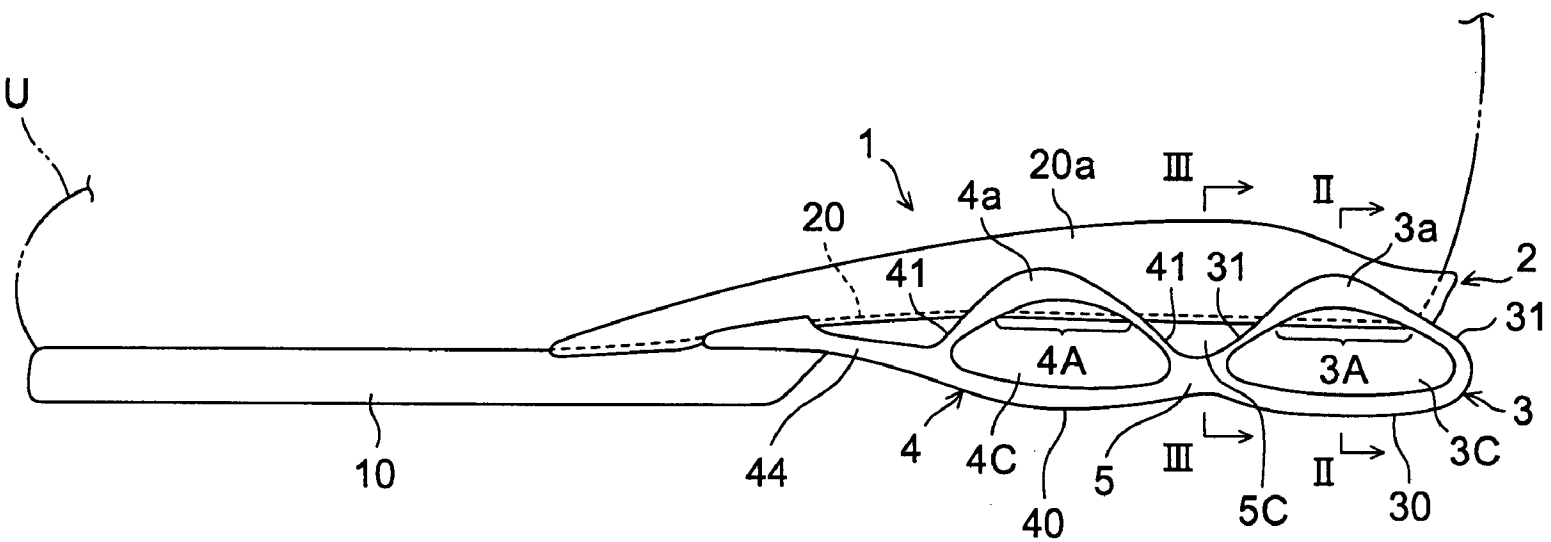
FIG. 1 is a side view of a sole structure according to a first embodiment of the present invention.
Figure 2:
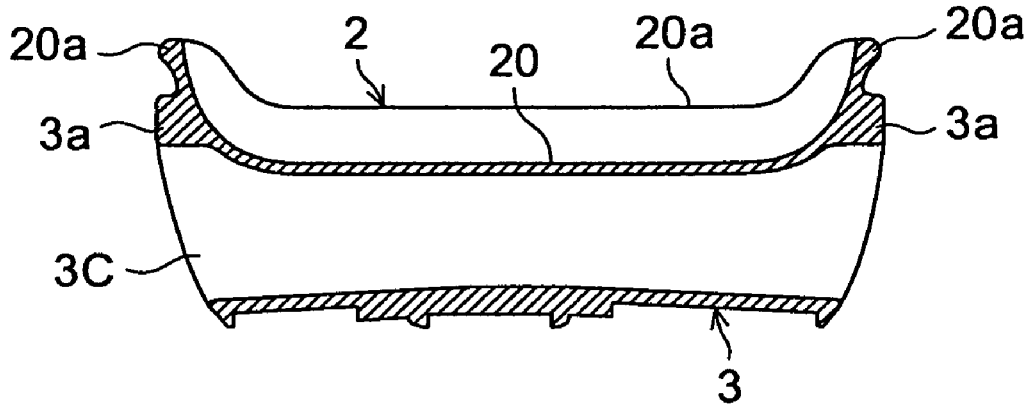
FIG. 2 is a cross sectional view of FIG. 1 taken along line II-II.
Figure 3:
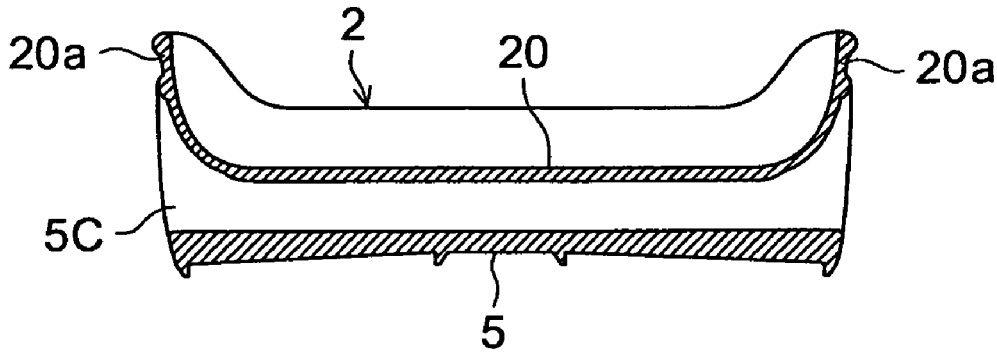
FIG. 3 is a cross sectional view of FIG. 1 taken along line III-III.

Referring now to the drawings, FIGS. 1 to 3 show a sole structure or a sole assembly for a shoe according to a first embodiment of the present invention. In these drawings, like reference numbers indicate identical or functionally similar elements. Here, a spike-less golf shoe is exemplified.

As shown in FIG. 1, a sole structure 1 comprises an upper plate 2 having at least a heel region, disposed on an upper side of the sole structure 1, and having a lower portion of an upper U of the shoe fixedly attached thereto, a first C-shaped portion 3 and a second C-shaped portion 4 each having a longitudinally flat, generally C-shape with an upwardly opening portion 3A, 4A, disposed alongside in the longitudinal direction under the upper plate 2, each opening end of the upwardly opening portions 3A, 4A being directly fixed to the upper plate 2, and a connecting portion 5 interposed between the first and second C-shaped portions 3, 4 and connecting the first and second C-shaped portions 3, 4.

The upper plate 2 has an upraised portion 20*a* extending upwardly from opposite side edge portions and a rear end edge portion of a base surface 20 of the upper plate 2, and the heel region of the upper plate 2 is formed in a heel-cup shape as shown in FIGS. 2 and 3. Side edge portions of the first and second C-shaped portions 3, 4 have upwardly extending portions 3*a*, 4*a* along the upraised portions 20*a*. (see FIG. 2). The upwardly extending portions 3*a*, 4*a* close the upwardly opening portion of the flat, generally C-shaped portions 3, 4, respectively. Thereby, in FIG. 1, which is a side view, of the sole structure, each of the C-shaped portions 3, 4 looks generally elliptical or lenticular shaped.

Preferably, the upper plate 2, the first and second C-shaped portions 3, 4, and the connecting portion 5 are integrally formed with each other using resin. As resin material, for example, thermoplastic resin such as thermo plastic polyurethane (TPU), polyamide elastomer (PAE) and the like are used. Thermosetting resin such as epoxy resin, unsaturated polyester resin and the like are also used. Furthermore, it is also possible to form the first and second C-shaped portions 3, 4 integrally with the upper plate 2 and the connecting portion 5 using ethylene-vinyl acetate copolymer (EVA), rubber or the like.

Figure 4A:
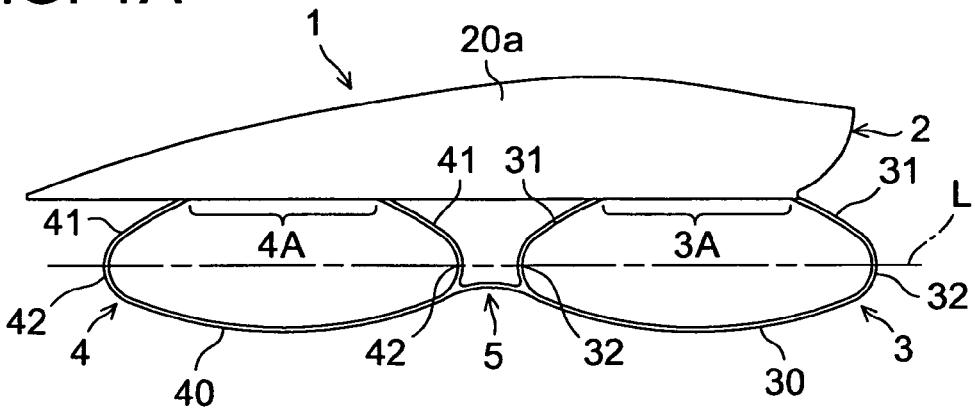
FIG. 4A is a side schematic view of the sole structure of FIG. 1.

Here, for the purpose of illustration simplification, FIG. 4A depicts the sole structure in which the upwardly extending portions 3*a*, 4*a* are removed from the first and second C-shaped portions 3, 4. As shown in FIG. 4A, the first and second C-shaped portions 3, 4 comprise downwardly convexly curved surfaces 30, 40, respectively, disposed under and opposite the upwardly opening portions 3A, 4A, and diagonally upwardly convexly curved surfaces 31, 41, respectively, extending diagonally upwardly from the downwardly convexly curved surfaces 30, 40 toward the upper plate 2.

Preferably, between the downwardly convexly curved surfaces 30, 40 and the diagonally upwardly convexly curved surfaces 31, 41 are formed longitudinally convexly curved surfaces 32, 42, respectively. The longitudinally convexly curved surfaces 32, 42 smoothly connect the downwardly convexly curved surfaces 30, 40 with the diagonally upwardly convexly curved surfaces 31, 41, respectively.

Also, inside the first and second C-shaped portions 3, 4 are formed voids 3C, 4C, respectively, and between the connecting portion 5 and the upper plate 2 is formed a void 5C.

The downwardly convexly curved surface 40 of the second C-shaped portion 4 located in front of the first C-shaped portion 3, as shown in FIG. 1, extends further forward beyond the C-shaped portion 4. A front end of the extension 44 is fixed to a lower surface of the upper plate 2. Also, a front end of the upper plate 2 is coupled to a sole 10 in a forefoot region.

The connecting portion 5 connects end portions of the downwardly convexly curved surfaces 30, 40 of the first and second C-shaped portions 3, 4 with each other. As is clearly seen in FIG. 4A, the connecting portion 5 has an upwardly convexly curved shape. Also, the connecting portion 5 is located under a longitudinal line L (see FIG. 4A) that connects the longitudinally most protruded points of the first and second C-shaped portions 3, 4.

Figure 4B:
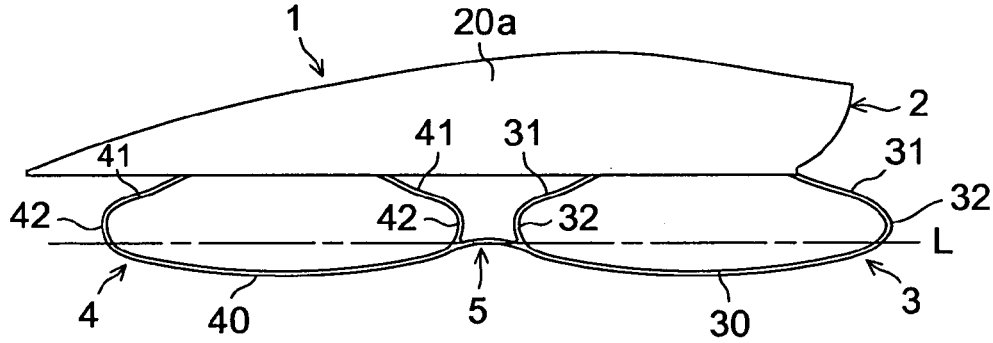
FIG. 4B illustrates a state after a compressive deformation of the sole structure of FIG. 4A.

At the time of a shoe strike onto the ground, when an impact load applied to the sole structure 1, as shown in FIG. 4B, the downwardly convexly curved surfaces 30, 40 of the first and second C-shaped portions 3, 4 compressively deform into a more flattened shape, and the diagonally upwardly convexly curved surfaces 31, 41 compressively deform into a more flattened or flatter shape, or so as to bend in a diagonally downwardly convexly curved shape. Also, the longitudinally convexly curved surfaces 32, 42 compressively deform into a more curved shape (i.e. to increase the degree of crookedness). Thereby, the entire C-shaped portions 3, 4 compressively deforms into a more flattened shape to absorb the impact load.

In this case, since the connecting portion 5 connects ends of the downwardly convexly curved surfaces 30, 40 of the C-shaped portions 3, 4 with each other, the compressive deformation of each of the downwardly convexly curved surfaces 30, 40 of the C-shaped portions 3, 4 is not hindered by the connecting portion 5, thus allowing for a smooth compressive deformation. Also, since the connecting portion 5 is located below the longitudinal line L, when the C-shaped portions 3, 4 deform compressively, the amount of compressive deformation of a lower portion of the C-shaped portions 3, 4 below the longitudinal line L is restrained, whereas the amount of compressive deformation of a upper portion of the C-shaped portions 3, 4 above the longitudinal line L is promoted. Moreover, since the connecting portion 5 has an upwardly convexly curved shape, the C-shaped portions 3, 4 and the connecting portions are formed in a longitudinally waved shape as a whole, thereby allowing the entire sole structure to deform compressively in a smoother manner.

In this case, at the time of the compressive deformation of the C-shaped portions 3, 4, because the C-shaped portions 3, 4 are coupled to each other via the connecting portion 5, the C-shaped portions 3, 4 are prevented from being excessively swung in the longitudinal direction (i.e. the left to right direction in FIG. 4B). Also, because the downwardly convexly curved surface 40 of the second C-shaped portion 4 located in front of the first C-shaped portion 3 extends further forward beyond the second C-shaped portion 4 and a front end of an extension 44 of the downwardly convexly curved surface 40 is fixed to the lower surface of the upper plate 2 (see FIG. 1), the extension 44 prevents the second C-shaped portion 4 from being excessively swung in the forward direction at the time of the compressive deformation of the second C-shaped portion 4.

In this case, although the ends of the upwardly opening portions 3A, 4A of the C-shaped portions 3, 4 are fixed to the upper plate 2, the entire C-shape of each of the C-shaped portions 3, 4 deforms so as to be compressed in the upper and lower direction at the time of the compressive deformation of the C-shaped portions 3, 4, thereby facilitating a compressive deformation to improve the cushioning properties.

In such a manner, since each of the C-shaped portions 3, 4 has a structure that facilitates a compressive deformation, in the case where the C-shaped portions 3, 4 are formed of material of a relatively high rigidity (e.g. high Young's modulus), the cushioning properties can be secured. Thereby, it is possible to make both the cushioning properties and durability compatible with each other.

Moreover, in this case, the first and second C-shaped portions 3, 4 are fixed to the upper plate 2 through the upwardly opening portions, respectively. That is, the first and second C-shaped portions 3, 4 are coupled to the upper plate 2 via four connecting parts. Thereby, at the time of a shoe strike onto the ground, a thrust from the ground is transmitted to the upper plate 2 through these four connecting parts, thus mitigating a thrust to a shoe wearer's foot.

Furthermore, in the present invention, since the C-shaped portions 3, 4 are fixedly attached to the upraised portion 20*a* of the heel region of the upper plate 2 via the upwardly extending portions 3*a*, 4*a*, these upwardly extending portions 3*a*, 4*a* exhibit a stabilizer effect in the lateral direction.

Also, in the present invention, the upper plate 2, the C-shaped portions 3, 4, and the connecting portion 5 are integral with each other using resin, thus allowing for ease of manufacture of the sole structure 1 to reduce manufacturing cost and also preventing the C-shaped portions 3, 4 and the upper plate 2 and the connecting portion 5 from being separated due to repetitive deformation of the C-shaped potions 3, 4.

In the above-mentioned embodiment, the upraised portion 20*a* is provided at the opposite side edge portions of the upper plate 2, but the present invention can be applied to an embodiment in which the upper plate 2 has no upraised portions.

Figure 5A:
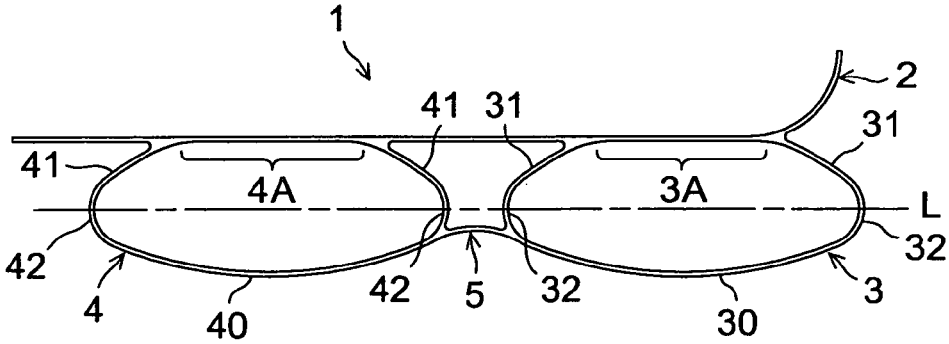
FIG. 5A is a side schematic view of a sole structure according to a second embodiment of the present invention.
Figure 5B:
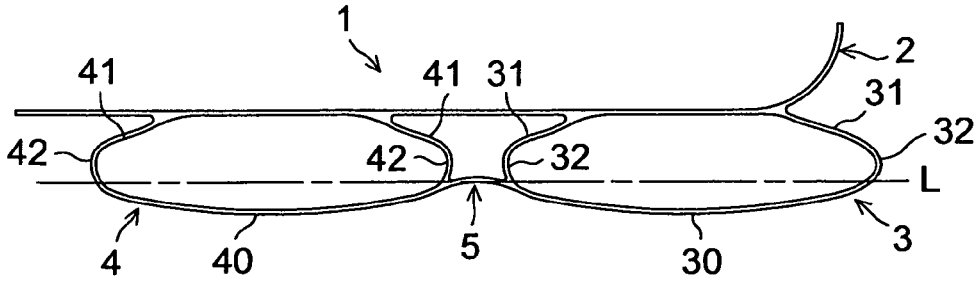
FIG. 5B illustrates a state after a compressive deformation of the sole structure of FIG. 5A.

FIGS. 5A and 5B show a sole structure according to a second embodiment of the present invention. In these drawings, the same numbers as those in the first embodiment indicate identical or functionally similar elements.

The second embodiment is similar to the first embodiment with the exception that the upper plate 2 does not have the upraised portion 20*a*. In this case, since the first and second C-shaped portions 3, 4 has no upwardly extending portions, each of the C-shaped portions 3, 4 looks generally C-shape as viewed from the side of the C-shaped portions 3, 4.

According to the second embodiment, as with the above-mentioned first embodiment, when an impact load acts on the sole structure 1 at the time of a shoe strike onto the ground, each of the downwardly convexly curved surfaces 30, 40 of the first and second C-shaped portions 3, 4 compressively deforms into a more flattened shape, each of the diagonally upwardly convexly curved surfaces 31, 41 compressively deforms into a more flattened or flatter shape, or a diagonally downwardly convexly curved shape, and each of the longitudinally convexly curved surfaces 32, 42 compressively deforms into a more curved shape (i.e. so as to increase the degree of crookedness) (see FIG. 5B). In such a manner, the entire C-shape of each of the C-shaped portions 3, 4 compressively deforms into a more flattened shape with ease. Thereby, the impact load is absorbed and the cushioning properties are secured.

Moreover, in this case, similar to the first embodiment, since the first and second C-shaped portions 3, 4 are fixedly attached to the upper plate 2 via the opening end portions and thus the first and second C-shaped portions 3, 4 are coupled to the upper plate 2 via four connecting parts, a thrust from the ground at the time of a shoe strike onto the ground is transmitted to the upper plate 2 via these four connecting parts, thereby relieving a thrust to the shoe wearer's foot.

Figure 6A:
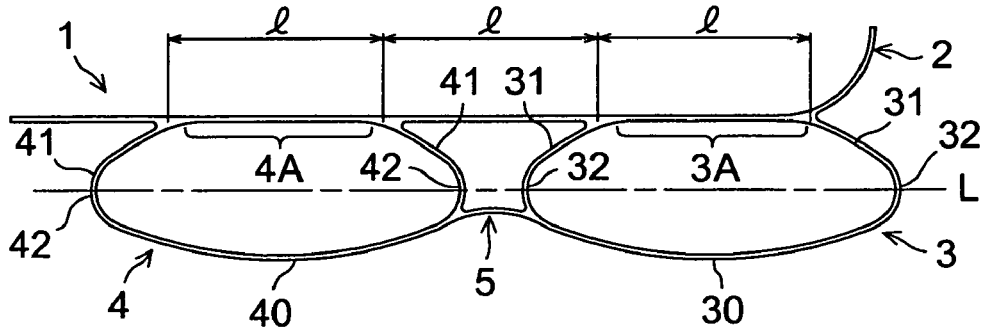
FIG. 6A is a side schematic view of a sole structure according to a third embodiment of the present invention.
Figure 6B:
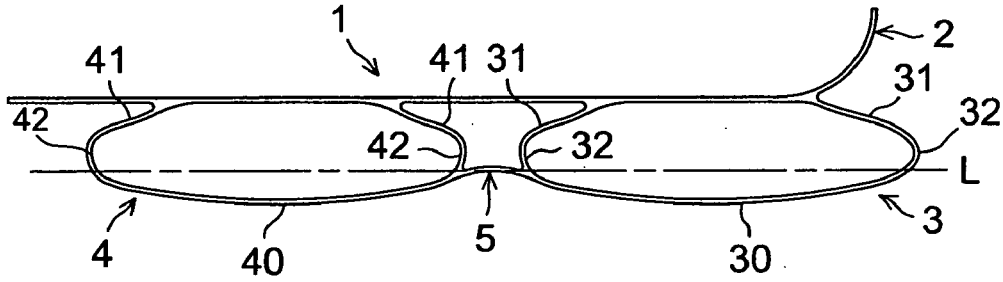
FIG. 6B illustrates a state after a compressive deformation of the sole structure of FIG. 6A.

FIGS. 6A and 6B show a sole structure according to a third embodiment of the present invention. In these drawings, the same numbers as those in the first embodiment indicate identical or functionally similar elements.

In this third embodiment, positions of the upwardly opening end portions of the first and second C-shaped portions 3, 4 are spaced equally along the upper plate 2 as shown in a distance 1 of FIG. 6A. That is, the distances 1 between the adjacent connecting parts of the C-shaped portions 3, 4 with the upper plate 2 are spaced equally along the upper plate 2. At the time of a shoe strike onto the ground, a thrust from the ground is equally distributed and transmitted to the upper plate 2 through these four connecting parts. Thereby, an undesirable thrust to the shoe wearer's foot can be further decreased.

Figure 7A:
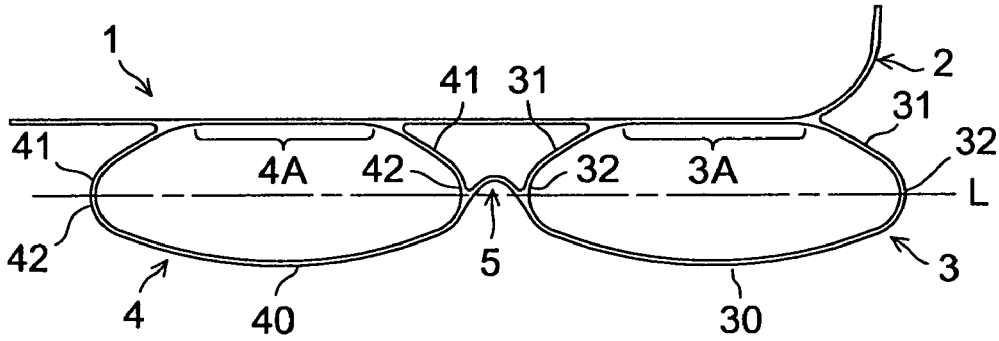
FIG. 7A is a side schematic view of a sole structure according to a fourth embodiment of the present invention.
Figure 7B:
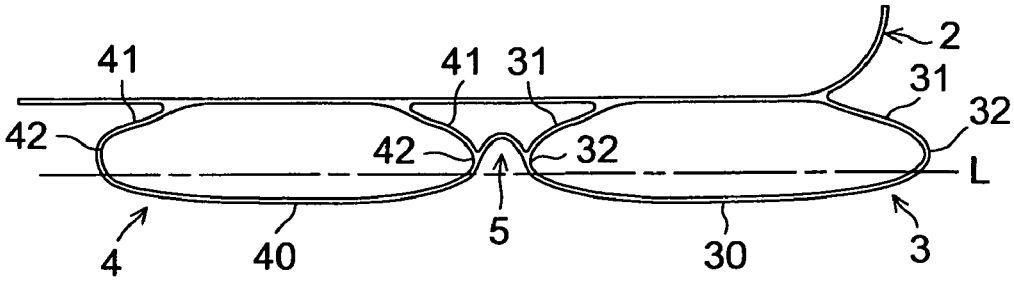
FIG. 7B illustrates a state after a compressive deformation of the sole structure of FIG. 7A.

FIGS. 7A and 7B show a sole structure according to a fourth embodiment of the present invention. In these drawings, the same numbers as those in the first embodiment indicate identical or functionally similar elements.

The fourth embodiment differs from the first to third embodiments in that the connecting portion 5 is located above the longitudinal line L connecting the longitudinally most protruded points of the first and second C-shaped portions 3, 4. Also, the connecting portion 5 has an upwardly convexly crooked shape, which has an increased degree of curvature as compared with the connecting portions 5 in the first to third embodiments. In the fourth embodiment, the connecting portion 5 is formed of two components extending from the first and second C-shaped portions 3, 4, respectively, and forming an acute angle.

In the fourth embodiment, since the connecting portion 5 is located above the longitudinal line L, at the time of a compressive deformation of each of the C-shaped portions 3, 4, the compressive deformation of an upper portion above the longitudinal line L is restrained, and at the same time the compressive deformation of a lower portion below the longitudinal line L is promoted. Also, since the connecting portion 5 has an upwardly convexly crooked shape, at the time of the compressive deformation of each of the C-shaped portions 3, 4, the connecting portion 5 deforms into a more crooked shape as shown in FIG. 7B. Thereby, the amount of compressive deformation of the entire sole structure can be further increased and the cushioning properties can thus be improved.

Figure 8A:
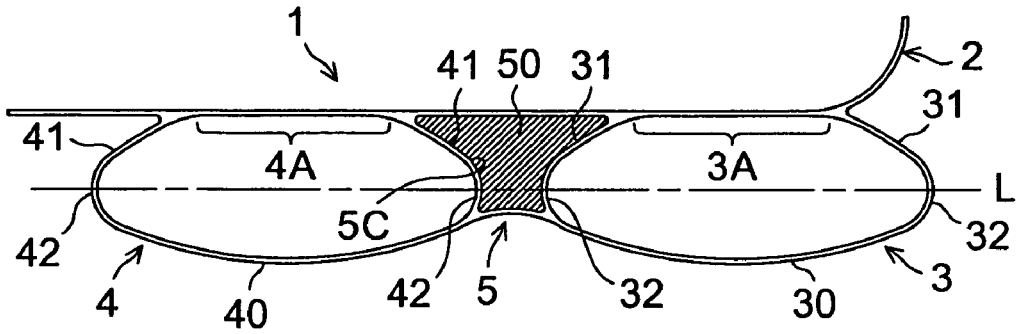
FIG. 8A is a side schematic view of a sole structure according to a fifth embodiment of the present invention.
Figure 8B:
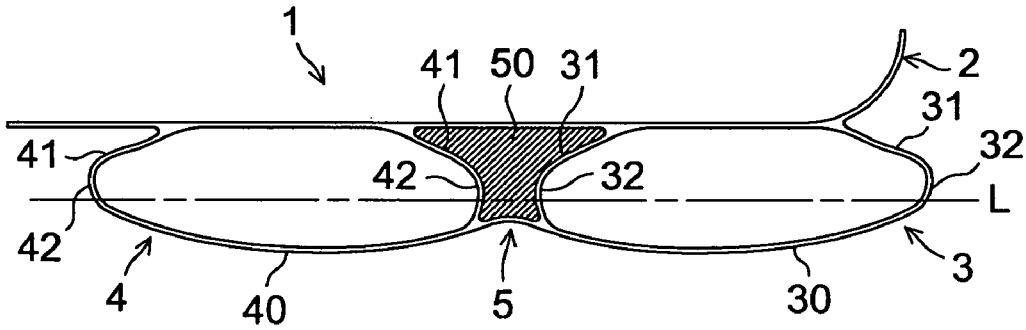
FIG. 8B illustrates a state after a compressive deformation of the sole structure of FIG. 8A.
Figure 9:
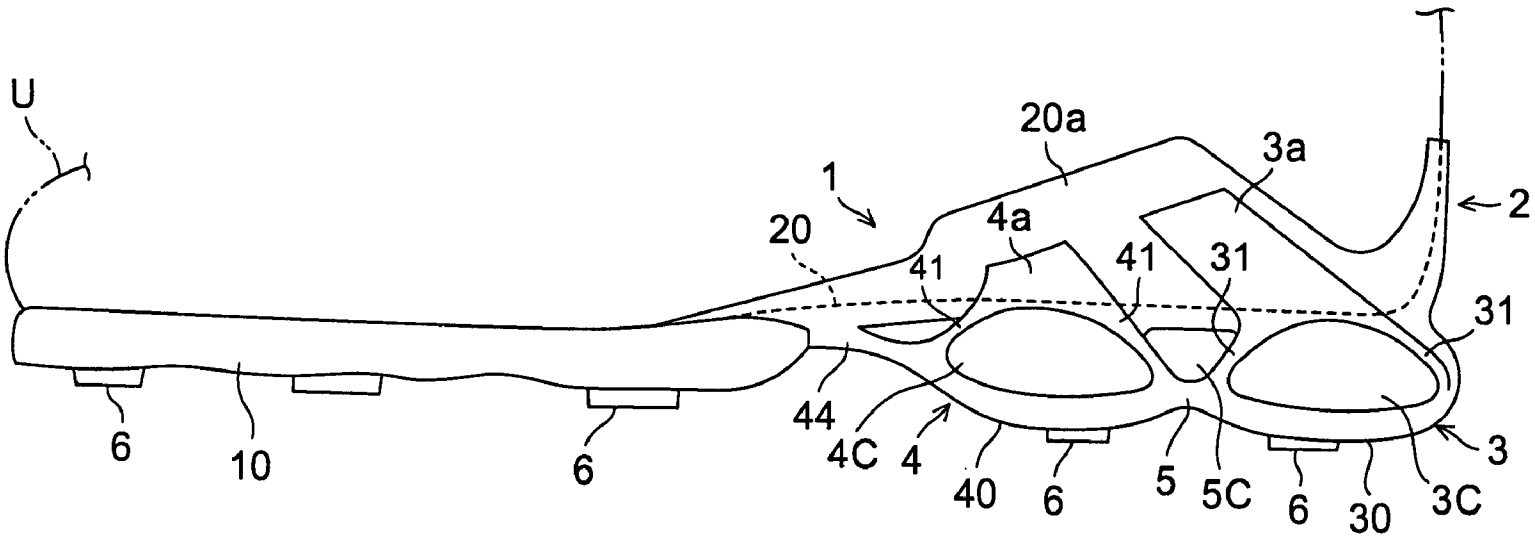
FIG. 9 is a side view of a sole structure according to a sixth embodiment of the present invention.

FIGS. 8A and 8B show a sole structure according to a fifth embodiment of the present invention. In these drawings, the same numbers as those in the first embodiment indicate identical or functionally similar elements.

In the fifth embodiment, a void 5*c* formed above the connecting portion 5 is filled with detachable cushioning member 50. The cushioning member 50 is provided to control the cushioning properties of the void C. As materials for the cushioning member 50, soft or hard elastic materials are preferable. For example, foamed resin such as EVA or the like, and foamed solid rubber, foamed rubber materials or the like are used. As to a position of the cushioning member 50, it may be located at a medial and/or a lateral side of the sole structure 1, or along the entire width of the sole structure 1.

In this case, elasticity of the cushioning member controls the amount of compressive deformations of each of the C-shaped portions 3, 4 and the connecting portion 5 to adjust the cushioning properties.

FIGS. 9A to 10B show a sole structure according to a sixth embodiment of the present invention. In these drawings, the same numbers as those in the first embodiment indicate identical or functionally similar elements. Here, a golf spike shoe is exemplified.

The sixth embodiment differs from the first embodiment in that a cleat 6 is provided at the center of a lower portion of each of the downwardly convexly curved surfaces 30, 40 of the first and second C-shaped portions 3, 4. Also, the shape of the upwardly extending portions 3*a*, 4*a* that extend upwardly along the upraised portion 20*a* from the side edge portions of the C-shaped portions 3, 4 is slightly different from that shown in FIG. 1.

Figure 10A:
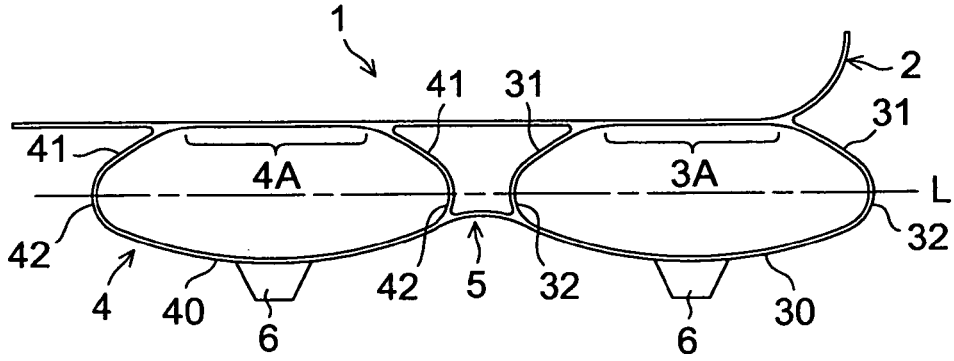
FIG. 10A is a side schematic view of the sole structure of FIG. 9.

FIG. 10A shows the sole structure in which the upwardly extending portions 3*a*, 4*a* are removed for the purpose of illustration simplification. As shown in FIG. 10A, the first and second C-shaped portions 3, 4 comprise downwardly convexly curved surfaces 30, 40, respectively, disposed below and opposite the upwardly opening portions 3A, 4A, diagonally upwardly convexly curved surfaces 31, 41, respectively, extending from the downwardly convexly curved surfaces 30, 40 toward the upper plate 2, and longitudinally convexly curved surfaces 32, 42, respectively, interposed between the downwardly convexly curved surfaces 30, 40 and the diagonally upwardly convexly curved surfaces 31, 41.

Figure 10B:
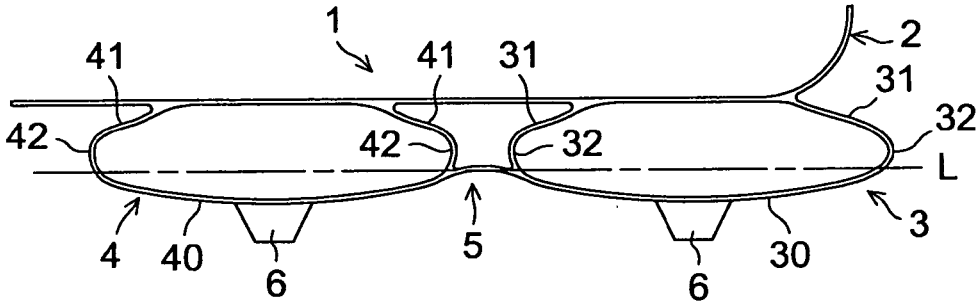
FIG. 10B illustrates a state after a compressive deformation of the sole structure of FIG. 10A.

At the time of a shoe strike onto the ground, when the cleat 6 contacts the ground, as shown in FIG. 10B, the downwardly convexly curved surfaces 30, 40 of the first and second C-shaped portions 3, 4 compressively deform into a more flattened shape via the cleat 6, the diagonally upwardly convexly curved surfaces 31, 41 compressively deform into a more flattened shape or a flatter shape or a diagonally downwardly convexly curved shape, and the longitudinally convexly curved surfaces 32, 42 compressively deform into a more curved shape (or so as to increase the degree of crookedness). Thereby, the entire C-shaped portions 3, 4 compressively deform into a more flattened shape and the shock load is thus absorbed to secure the cushioning properties.

Also, in this case, the first and second C-shaped portions 3, 4 are fixed to the upper plate 2 via the opening end portions. That is, the C-shaped portions 3, 4 are coupled to the upper plate 2 via four connecting parts. Thereby, at the time of a shoe strike onto the ground, a thrust from the ground is transmitted to the upper plate 2 through these four connecting parts. As a result, a thrust from the cleat 6 to the shoe wearer's foot can be relived.

In the sixth embodiment, the cleat 6 was provided at the center of the lower portion of each of the downwardly convexly curved surfaces 30, 40 of the first and second C-shaped portions 3, 4, but the present invention is not limited to such an example.

Figure 11A:
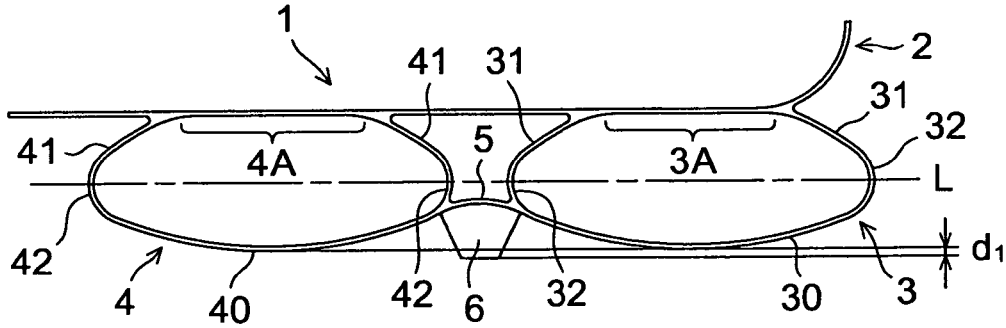
FIG. 11A is a side schematic view of a sole structure according to a seventh embodiment of the present invention.
Figure 11B:
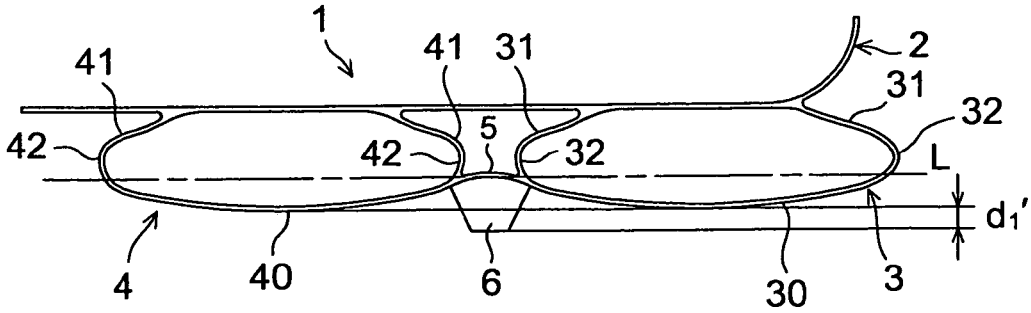
FIG. 11B illustrates a state after a compressive deformation of the sole structure of FIG. 11A.

FIGS. 11A and 11B show a sole structure according to a seventh embodiment of the present invention. In these drawings, the same numbers as those in the sixth embodiment indicate identical or functionally similar elements.

In this seventh embodiment, the cleat 6 is provided at the lower portion of the connecting portion 5.

At the time of a shoe strike onto the ground, after the cleat 6 contacts the ground, the downwardly convexly curved surfaces 30, 40 of the first and second C-shaped portions 3, 4 contact the ground and each of the C-shaped portions 3, 4 compressively deforms into a more flattened shape. Then, after the compressive deformation of the C-shaped portions 3, 4, the amount of protrusion of the cleat 6 from the downwardly curved surfaces 30, 40 has become $d_1'$ (see FIG. 11B) from $d_1$ ($<d_1'$) in the state before the ground contact of the cleat 6. The amount of protrusion of the cleat 6 has thus increased, thereby increasing a grip by the cleat 6.

On the other hand, when each of the downwardly convexly curved surfaces 30, 40 of the C-shaped portions 3, 4 leaves the ground, each of the downwardly convexly curved surfaces 30, 40 returns to its original position and the amount of protrusion of the cleat 6 from the downwardly curved surfaces 30, 40 thus decreases. As a result, an easy pull-out of the cleat 6 from the ground is achieved.

In the seventh embodiment, the cleat 6 was provided directly at the lower surface of the connecting portion 5, but the present invention is not limited to such an example.

Figure 12A:
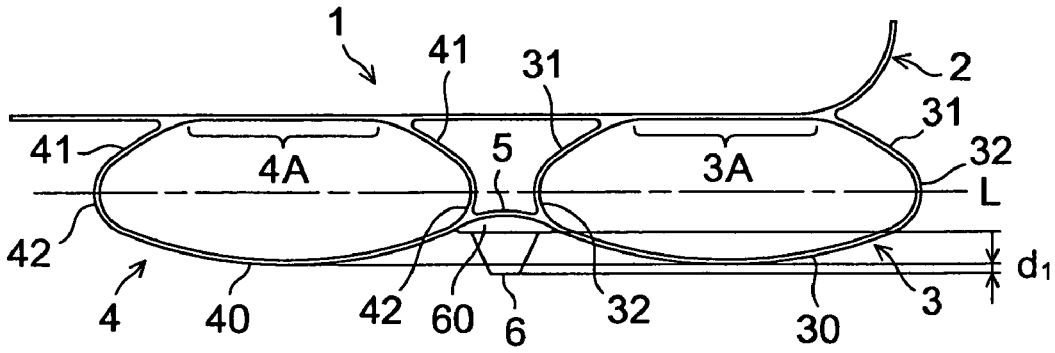
FIG. 12A is a side schematic view of a sole structure according to an eighth embodiment of the present invention.
Figure 12B:
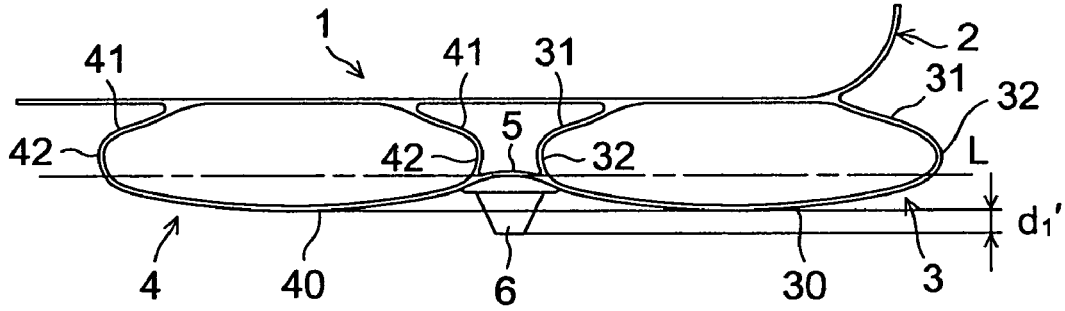
FIG. 12B illustrates a state after a compressive deformation of the sole structure of FIG. 12A.

FIGS. 12A and 12B show a sole structure according to an eighth embodiment of the present invention. In these drawings, the same numbers as those in the seventh embodiment indicate identical or functionally similar elements.

In the eighth embodiment, the cleat 6 is provided at the lower surface of the connecting portion 5 through a base portion 60.

In this case, the base portion 60 increases the rigidity of the connecting portion 5 and deformation of the connecting portion 5 in the upper and lower directions can be restrained. As a result, the cleat 6 can exhibit traction relative to the ground effectively. Also, in this case, the amount of a stab of the cleat 6 relative to the ground can be adjusted by the position of the base portion in the upper and lower directions.

In the above-mentioned embodiments, the upper plate 2, the first and second C-shaped portions 3, 4, and the connecting portion 5 were integrally formed with each other using resin, but the present invention is not limited to such an example. For example, the C-shaped portions 3, 4 and the connecting portion 5 are integrally formed with each other using resin, and the upper plate is provided that was formed in a separate process. Then, an integrated article formed of the C-shaped portions 3, 4 and the connecting portion 5 may be bonded to the upper plate 2.

In the above-mentioned embodiments, there were two C-shaped portions provided in the sole structure, but the present invention can be applied to the sole structure with three or more C-shaped portions. In this case, the longitudinally adjacent C-shaped portions are coupled to each other through the connecting portion.

In the above-mentioned embodiments, the connecting portion 5 had an upwardly convexly curved or crooked shape, but the present invention can be applied to the sole structure in which the connecting portion has a flat shape.

In this case as well, at the time of a shoe strike onto the ground, each of the downwardly convexly curved surfaces 30, 40 of the first and second C-shaped portions 3, 4 compressively deforms into a more flattened shape, and the diagonally upwardly convexly curved surfaces 31, 41 compressively deforms into a more flattened or flatter shape or an upwardly convexly curved shape. Thereby, the compressive deformation of the C-shaped portions 3, 4 is facilitated and the cushioning properties can thus be improved.

In the above-mentioned embodiments, the example was shown in which the C-shaped portion was provided at the heel region of the upper plate to facilitate a compressive deformation of the heel region to improve the cushioning properties of the heel region and to relieve a thrust from the ground to the heel region. However, the present invention is not limited to such an example.

The upper plate may extend to the midfoot region of the shoe, or to the forefoot region through the midfoot region, and the C-shaped portion may be provided at the midfoot region and/or the forefoot region.

In these cases, compressive deformation of the midfoot region and/or the forefoot region becomes easy to improve the cushioning properties of the midfoot region and/or the forefoot region and to relieve a thrust from the ground to the midfoot region and/or the forefoot region.

In above-mentioned embodiments, a golf shoe was taken as an example, but the sole structure of the present invention can be applied to a sports shoe (including a cleats shoe) such as a running shoe or the like.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

an upper plate having at least a heel region and being disposed on an upper side of the sole structure;

a first C-shaped portion and a second C-shaped portion that are disposed under the upper plate one ahead of another in a longitudinal direction extending along a length of the sole structure, wherein each one of the C-shaped portions respectively has a lying-down C-shape with an upwardly directed opening as viewed in a transverse direction extending transversely to the longitudinal direction, wherein each one of the C-shaped portions respectively has two end portions that border the opening and that are directly fixed to the upper plate, and wherein the upper plate has a respective flat planar portion respectively adjoining and spanning a respective one of the upwardly directed openings; and a connecting portion interposed between and connecting the first and second C-shaped portions.

2. The sole structure according to claim 1, wherein each one of the first and second C-shaped portions respectively comprises a downwardly convexly curved surface disposed under and opposite the upwardly directed opening, and a diagonally upwardly convexly curved surface extending diagonally upwardly from the downwardly convexly curved surface toward the upper plate.

3. The sole structure according to claim 2, wherein the downwardly convexly curved surface and the diagonally upwardly convexly curved surface are coupled to each other through a longitudinally convexly curved surface.

4. The sole structure according to claim 1, wherein the end portions of the first and second C-shaped portions fixed to the upper plate are spaced equally from one another in the longitudinal direction along the upper plate.

5. The sole structure according to claim 1, wherein the connecting portion is located above a longitudinal line that connects a longitudinally most protruded point of the first C-shaped portion and a longitudinally most protruded point of the second C-shaped portion.

6. The sole structure according to claim 1, wherein the connecting portion has an upwardly convexly curved shape.

7. The sole structure according to claim 1, wherein the connecting portion has an upwardly convexly crooked shape.

8. The sole structure according to claim 1, wherein the upper plate, the first and second C-shaped portions, and the connecting portion are resin-formed integrally with each other.

9. The sole structure according to claim 1, wherein there is formed a void above the connecting portion, the void being filled with cushioning materials.

10. The sole structure according to claim 1, further comprising a cleat at a lower portion of the downwardly convexly curved surface that is located opposite the opening of one of the C-shaped portions.

11. The sole structure according to claim 1, further comprising a cleat at a lower portion of the connecting portion.

12. The sole structure according to claim 11, wherein the cleat is provided through a base portion.

13. A sole structure for a shoe comprising:

an upper plate having at least a heel region and being disposed on an upper side of the sole structure;

a first C-shaped portion and a second C-shaped portion that are disposed under the upper plate one ahead of another in a longitudinal direction extending along a length of the sole structure, wherein each one of the C-shaped portions respectively has a lying-down C-shape with an upwardly directed opening as viewed in a transverse direction extending transversely to the longitudinal direction, and wherein each one of the C-shaped portions respectively has two end portions that border the opening and that are directly fixed to the upper plate; and a connecting portion interposed between and connecting the first and second C-shaped portions;

wherein each one of the first and second C-shaped portions respectively comprises a downwardly convexly curved surface disposed under and opposite the upwardly directed opening, and a diagonally upwardly convexly curved surface extending diagonally upwardly from the downwardly convexly curved surface toward the upper plate; and wherein the downwardly convexly curved surface of the first C-shaped portion located in front of the second C-shaped portion extends beyond the diagonally upwardly convexly curved surface of the first C-shaped portion further in a forward direction, and a front end of the downwardly convexly curved surface of the first C-shaped portion is fixedly attached to a lower surface of the upper plate.

14. A sole structure for a shoe comprising:

an upper plate having at least a heel region and being disposed on an upper side of the sole structure;

a first C-shaped portion and a second C-shaped portion that are disposed under the upper plate one ahead of another in a longitudinal direction extending along a length of the sole structure, wherein each one of the C-shaped portions respectively has a lying-down C-shape with an upwardly directed opening as viewed in a transverse direction extending transversely to the longitudinal direction, and wherein each one of the C-shaped portions respectively has two end portions that border the opening and that are directly fixed to the upper plate; and a connecting portion interposed between and connecting the first and second C-shaped portions;

wherein each one of the first and second C-shaped portions respectively comprises a downwardly convexly curved surface disposed under and opposite the upwardly directed opening, and a diagonally upwardly convexly curved surface extending diagonally upwardly from the downwardly convexly curved surface toward the upper plate; and wherein the connecting portion connects an end of the downwardly convexly curved surface of the first C-shaped portion with an end of the downwardly convexly curved surface of the second C-shaped portion.

15. A sole structure for a shoe comprising:

an upper plate having at least a heel region and being disposed on an upper side of the sole structure;

a first C-shaped portion and a second C-shaped portion that are disposed under the upper plate one ahead of another in a longitudinal direction extending along a length of the sole structure, wherein each one of the C-shaped portions respectively has a lying-down C-shape with an upwardly directed opening as viewed in a transverse direction extending transversely to the longitudinal direction, and wherein each one of the C-shaped portions respectively has two end portions that border the opening and that are directly fixed to the upper plate; and a connecting portion interposed between and connecting the first and second C-shaped portions;

wherein the heel region of the upper plate has an upraised portion projecting upwardly from a side edge portion of the heel region, and wherein a respective side edge portion of each one of the first and second C-shaped portions has an upwardly extending portion along the upraised portion.

16. A sole structure for a shoe comprising:

an upper plate having at least a heel region and being disposed on an upper side of the sole structure;

a first C-shaped portion and a second C-shaped portion that are disposed under the upper plate one ahead of another in a longitudinal direction extending along a length of the sole structure, wherein each one of the C-shaped portions respectively has a lying-down C-shape with an upwardly directed opening as viewed in a transverse direction extending transversely to the longitudinal direction, and wherein each one of the C-shaped portions respectively has two end portions that border the opening and that are directly fixed to the upper plate; and a connecting portion interposed between and connecting the first and second C-shaped portions;

wherein the connecting portion is located below an imaginary longitudinal line that connects a longitudinally most protruded point of the first C-shaped portion and a longitudinally most protruded point of the second C-shaped portion.

17. A sole structure for a shoe, comprising:

an upper plate;

first and second C-shaped elements that are disposed under the upper plate, with the first C-shaped element disposed in front of the second C-shaped element in a longitudinal direction extending along a length of the sole structure, wherein each one of the C-shaped elements respectively has a lying-down C-shaped cross-section with an upwardly directed opening as viewed transversely to the longitudinal direction, and wherein each one of the C-shaped elements respectively has two upper edges that border the opening thereof and that are directly fixed to the upper plate; and a connecting element that extends between and connects the first and second C-shaped elements;

wherein the upper plate includes a flat planar plate portion adjoining and spanning the upwardly directed opening, and/or the C-shaped elements are C-shaped trough elements extending continuously over a width of the sole structure.

18. The sole structure according to claim 17, wherein the upper plate includes the flat planar plate portion adjoining and spanning the upwardly directed opening.

19. The sole structure according to claim 18, wherein the C-shaped elements are the C-shaped trough elements extending continuously over the width of the sole structure.

20. The sole structure according to claim 17, wherein the C-shaped elements are the C-shaped trough elements extending continuously over the width of the sole structure.

21. The sole structure according to claim 17, wherein the lying-down C-shaped cross-section of each one of the C-shaped elements includes a bottom portion that is downwardly convexly curved, front and rear portions that are outwardly convexly curved away from one another in the longitudinal direction, and two upper portions that are obliquely upwardly convexly curved and that slope obliquely upwardly from the front and rear portions and terminate at the upper edges.

22. The sole structure according to claim 21, further comprising an extension element that extends forwardly from the bottom portion of the first C-shaped element and is connected to a lower surface of the upper plate.

23. The sole structure according to claim 21, wherein the connecting element connects a forward end of the bottom portion of the second C-shaped element with a rear end of the bottom portion of the first C-shaped element.

24. The sole structure according to claim 17, wherein the upper ends of the C-shaped elements are all spaced equally from one another in the longitudinal direction along the upper plate.

25. The sole structure according to claim 17, further comprising an upraised portion that projects upwardly from a side edge of the upper plate, and an upwardly extending portion that extends upwardly along the upraised portion from a side edge of one of the C-shaped elements.

26. The sole structure according to claim 17, wherein the connecting element is located below an imaginary longitudinal line that passes through a longitudinally longest portion of the respective C-shaped elements when the sole structure is not being loaded.

27. The sole structure according to claim 17, wherein the connecting element has an upwardly convexly curved cross-section as viewed transversely to the longitudinal direction.

28. The sole structure according to claim 17, wherein the upper plate, the C-shaped elements and the connecting portion are all formed integrally together as a single monolithic piece of plastic resin.

* * * * *